United States Patent [19]

Walter

[11] Patent Number: 4,977,832

[45] Date of Patent: Dec. 18, 1990

[54] METHOD AND APPARATUS FOR COORDINATING A PRINTING PRESS CONTROL WITH A HARD COPY IMAGE

[75] Inventor: Claus Walter, Glauburg, Fed. Rep. of Germany

[73] Assignee: Man Roland Druckmaschinen AG, Offenbach am Main, Fed. Rep. of Germany

[21] Appl. No.: 389,315

[22] Filed: Aug. 3, 1989

[30] Foreign Application Priority Data

Aug. 3, 1988 [DE] Fed. Rep. of Germany ..... 3826385

[51] Int. Cl.[5] ..... B41F 31/02

[52] U.S. Cl. ..... 101/365; 101/DIG. 47

[58] Field of Search ..... 101/DIG. 47, DIG. 45, 101/365; 364/519

[56] References Cited

U.S. PATENT DOCUMENTS 4,639,776 1/1987 Foerster et al. ..... 101/365 X

*Primary Examiner*—Clifford D. Crowder

*Attorney, Agent, or Firm*—Leydig, Voit & Mayer

[57] ABSTRACT

A system (and related method) for coordinating electronic zonal control of a printing press to a hard copy image of the printed form. The system supports a hard copy image in register with an optical source which projects an optical mark onto the image. The optical mark is traversed to selected points on the image. The zonal control information is stored in electronic memory means and can be displayed on an electronic display. Neither the electronic display nor the electronic memory have means for storing the actual image pattern. The electronic display has means for displaying a cursor and traversing the cursor across the displayed zone-by-zone information. The system provides means for translating coordinate information from the optical mark projected onto the hard copy image and controlling the cursor position on the electric display so as to correlate image positions from the hard copy with control zone information in the electronic display.

13 Claims, 1 Drawing Sheet

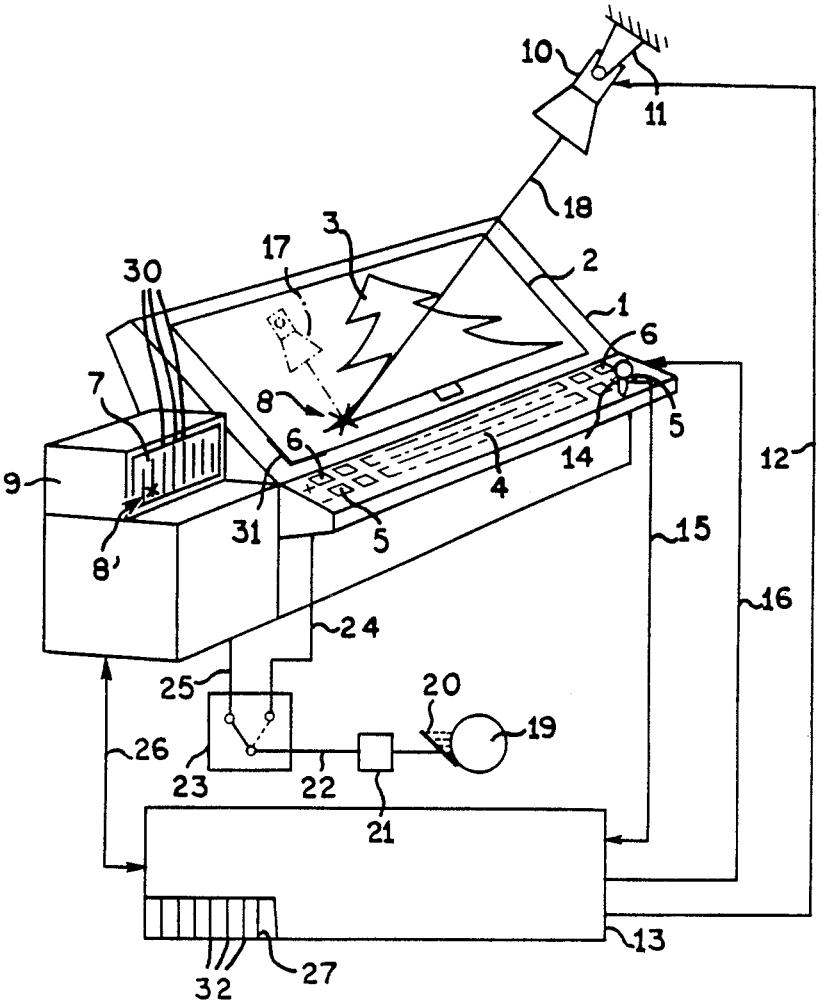
10
11
18
3
17
30
2
1
6
7
8
5
14
12
9
6
4
31
5
15
8'
16
24
25
20
19
26
23
22
21
13
32
27

METHOD AND APPARATUS FOR COORDINATING A PRINTING PRESS CONTROL WITH A HARD COPY IMAGE

FIELD OF THE INVENTION

This invention relates to printing presses, and more particularly to a system and apparatus for zone-by-zone control of ink press parameters.

BACKGROUND OF THE INVENTION

A typical example of zone-by-zone printing press control is ink or water feed control done on an incremental basis across the respective ink or water fountains. A press control console is usually provided for controlling ink or water feed and typically has an elongated array of ink control keys arranged in pairs (an increase and decrease key for each zone), and the key pairs are displaced across the control panel at a spacing related to the zone size established by the adjusters in the fountain. Thus, the zone size established by the adjusters in the fountain, and the keys on the control panel correspond to that spacing to allow the press operator the opportunity to mentally coordinate adjustments he is making on a zone-by-zone basis with the requirements or deficiencies in the sheet being printed. In electronic control systems, memories are usually provided for storing control information on a zone-by-zone basis. Such control information can include, for example, desired optical density information for each zone, actual optical density information for each zone, the ink fountain settings for each zone, and the like. In many systems, it is left to the operator, however, to mentally coordinate the electronically stored information, which is stored on a zone-by-zone basis, with the resulting printed image. The operator can attempt to coordinate the two by estimating zone positions on the printed sheet either mentally or by juxtaposing the sheet with the ink keys on the control panel.

Published German patent application No. DE-Al 3 325 006 discloses a display device for ink control system for printing presses wherein ink density values, adjustment and tolerance values, set values, and actual values are displayed on a display screen. The values to be displayed are either keyed in on an ink control panel, or detected by detectors disposed in ink zones on the press. Provision is made for scanning the actual image pattern from a hard copy image of the printed form, such as by means of a standard video camera. The video information is translated and stored for display on the same screen which displays the control information. Thus, the display screen not only displays the control information but also a superimposed image of the form being printed, so that the pressman can make a definite association between the displayed values of control information and the displayed superimposed image. Thus, deviations in the control parameters can be related to the actual image at a glance, and the operator has the opportunity to immediately make the necessary corrections. However, a primary disadvantage of this known apparatus is the need for an expensive recording device such as a video camera for scanning of the image, and the further complex electronics needed for converting the image into electronic signals compatible with the control system display, an image mixer for mixing the control information and the image information, and the necessary composite signal generator for superimposing both images on the same display screen.

SUMMARY OF THE INVENTION

In view of the foregoing, it is a general aim of the present invention to provide an improved system for correlating hard copy image information with electronically stored zonal control information, but without the need for actually converting the image pattern to electronic information for display.

In that regard, it is an object of the present invention to provide a means for defining an image point on a hard copy of the printed form and automatically correlating that image point to control zones in the electronic control.

Thus, it is an object to provide the pressman with highly efficient to correlate the image of the printed form with the control zones used to print the form, but without the necessity to convert the hard copy form in toto to an electronic image of the hard copy form.

It is a feature of the invention to provide the operator with the ability to traverse an optical indicator or mark across a hard copy image of the printed form, while at the same time correlating the image point identified by the optical mark with the control zones which are identified in the electronics of the control system. In a preferred implementation of the invention, an electronic display, such as a CRT, displays control information to the pressman on a zone-by-zone basis; the electronic display is provided with an electronic cursor having a position on the screen which is correlated to the position of the optical mark on the hard copy image. Thus, the pressman is provided with a one-to-one correspondence between an image point and the location of the control zone in the press which is printing that image point.

In practicing the invention, there is provided a system for coordinating a zonal control in a printing press to a hard copy image of the printed form. The system has a support for the hard copy image and means for registering the hard copy image on the support. An electronic memory within the control system has control zones for controlling the respective zones of the press in order to produce reproductions of the image. The electronic memory stores control information for the respective zones but does not have the capability for storing the actual image pattern Optical means are associated with the support and are adapted to project an optical mark onto the hard copy image which is registered on the support. An optical control means traverses the mark across the registered image and produces coordinate information relating to the current position of the projected mark with respect to the registered image. Translating means then translates that coordinate information into control information for the control zones and stores the control information in the electronic memory means, thereby to coordinate the hard copy image areas with the control zones which control the reproduction of that image. In the preferred implementation of the invention, an electronic display is also provided for displaying information stored in the electronic memory on a control-zone-by-control-zone basis. A cursor on the electronic display is provided and is moved in coordination with the optical marks on the hard copy image to serve as a further aid in coordinating the hard copy image with control zone information.

Other objects and advantages will become apparent from the following detailed description when taken in conjunction with the drawings, in which:

BRIEF DESCRIPTION OF THE DRAWING

The sole drawing is a diagram illustrating a system constructed in accordance with the present invention and adapted for use in practice of the method according to the present invention.

While the invention will be described in connection with certain preferred embodiments, there is no intent to limit it to those embodiments. On the contrary, the intent is to cover all alternatives, modifications and equivalents included within the spirit and scope of the invention as defined by the appended claims.

DETAILED DESCRIPTION OF THE PREFERRED EMBODIMENTS

Turning now to the sole drawing, there is illustrated a control panel 1 which serves as a support for a hard copy form 2 bearing an image 3 to be printed by the printing press (not shown) which is operated by means of the control panel 1. The invention will be described in connection with zonewise control of ink, and thus the control panel 1 is illustrated as having an array of ink control keys represented by increase keys 6 and decrease keys 5. Not all of the keys 5, 6 are illustrated in the drawing, in order to avoid overcomplicating the showing, but it will be appreciated by those skilled in the art that the keys 5, 6 are arranged in pairs (for increase and decrease) on an incremental basis across the base 4 of the control panel 1. The spacing of the keys is typically arranged to be the same as that of the control zones in the ink fountain, such that when a printed form is positioned on the support surface of the control panel, the pairs of ink control keys can be correlated generally with the zones on the printed form which they control. However, placement of the sheet on the table is not always easily done or done with adequate accuracy. Furthermore, in some cases it is desired to locate the control panel 1 in such a location that control is accomplished without actually bringing the printed form to the control panel, particularly if off-line or on-line densitometers are used to produce zone-by-zone density readings which are displayed at the control panel without the need for actually viewing of the form. In those cases the hard copy image can be a composition pattern, such as the pattern from which the plates were made, or a check proof, and that image remains on the console throughout the press run.

It is noted parenthetically at this point that while the specification will focus on zone-by-zone control of ink in a rotary printing press, since that is currently believed to be the most typical application of the invention, the invention is applicable more broadly to any press function, (including dampeners or control of other zonal adjustments) which affect the printed form on a zone-by-zone basis and thus require correlation by the operator of image points on a hard copy image to zonal control in the press.

Returning attention to the drawing, it is seen that there is associated with the control panel 1, a display unit 9 having an electronic display screen 7 for displaying system control information on a zone-by-zone basis. The zones are illustrated by vertical lines 30 on the display screen 7. As is conventional, the display screen 7 can be used to display ink density values, set point and tolerance values for ink adjustment, as well as set values and actual values of printed density. The values to be displayed, in the case of ink fountain adjustments, can be keyed in via the ink adjustment keys 5, 6, or alternatively can be displayed as a function of feedback elements on the ink control fountain. Density values for display can be actual spot or integrated density values taken from the printed sheet, or from the form used to produce the plates which will print the sheet. The density values can be keyed in manually, or entered automatically using known equipment and techniques. In any event, it is typical for values to be displayed on the screen on a zone-by-zone basis, as suggested by the lines 30, to indicate to the pressman the setting of the zones for the press, and when actual printed values are displayed, a measure of the quality of the print being produced by the press at that time.

As a feature of the invention, in contradistinction to the prior art, the display screen 7 has no provision for actually displaying the pattern of the printed image; thus, without the invention, the operator would be left to somehow mentally estimate the relationship between the control zones 30 displayed on screen 7, the control zones for adjustment on the control panel 4, and the relationship of the image 3 on the form 2. That correlation is rendered more difficult by the fact that the display screen 7 is typically of a reduced scale (as compared to the size of the printed image). In practicing the invention, means are provided for assisting in that task by correlating image points on the hard copy image 2 with control zones on the display 7 (or the associated electronic memory) to give the operator at a glance the precise correspondence between the image point and the control zone which is producing the image.

To that end, means are provided for identifying an image spot on the form 2 and correlating that spot to a position in the electronic control such as on the display screen 7. In the illustrated embodiment, optical means such as a coherent light source 10 is fixed in position with respect to control console 1 and is adapted, as by pivoting at 11, to traverse an optical mark 8 such as a cross hair or cursor across the surface of the control panel. As noted, the light source 10 is preferably coherent, and is preferably a laser device which projects a thin beam 18 to form an optical mark 8 on the control panel. The optical mark 8 can be of any desired configuration, such as a cross hair, circular spot, a square highlight area, and underlining cursor or the like. A hard copy image of the printed form, typically a composition pattern used to make the plate from which the form will be printed, is positioned on the supporting surface of the control panel 1 and is accurately registered in position on that surface such as by register means schematically illustrated at 31. Thus, when a light beam 18 emitted by optical source 10 traverses the optical mark 8 across the surface of the control panel 1, since the printed form 2 is accurately registered on that surface, the system has accurately identified image points on the form 2 with respect to a known reference. Typically, such points are identified by the X and Y coordinates of the optical mark with respect to a set reference. In short, by pivoting of light source 10, the optical mark 8 is traversed to respective positions on the surface of the control panel 1, and thus image points on the form 2 which underly the optical mark 8 are identified by the coordinate information derived from the angular position (if the light source is pivoted) of the light source 10.

In the preferred practice of the invention, the position of the light source 10 is controlled by an omni-directional operator control illustrated herein as joystick 14. The joystick 14 is representative of other forms of omnidirectional control, including a track ball, mouse, graphic tablet or even a set of cursor keys. The omnidirectional control produces electrical signals which are coupled on a line 15 to an electronic control system 13 which translates the joystick position into output signals. The output signals are coupled on line 12 to light source 10 so as to cause the light source 10 to follow the position of joystick 14 in traversing the optical spot 8 across the registered image. In short, an operator standing at the control panel 1, has the facility to manipulate the joystick 14 and by means of the control between joystick position 14 and position of the light source 10, can index the optical mark 8 to any point on the registered form 2.

In practicing the invention, the coordinate information which is utilized to index the optical mark 8 is also utilized in the electronic control system 13 by translating circuitry which forms an integral part of the electronic control system 13. Such translating circuitry serves to translate coordinate information identifying the position of optical mark 8 with respect to the form, into an electrical signal which relates that position to a location in the array of control zones for the control system. In the embodiment illustrated in FIG. 1, the electronic control 13 performs a translation on the coordinate information and, operating on line 26, provides a signal to electronic display 7 which illuminates a cursor 8' on the display screen 7. The shape of the cursor 8' is preferably the same as that of the optical mark 8, although identity of shape is not essential. The term "cursor" is used herein simply to differentiate the electronically displayed indicator from the optically projected indicator, and implies no specific shape. In any event, the position of the cursor 8' is controlled by the electronic control 13 and its internal translation circuitry to follow the position of optical mark 8 on the printed form 2. Recalling that the vertical lines 30 represent the control zones on the electronic display 7, it will thus be appreciated that the operator by manipulating joystick 14 can identify a particular image point on the printed form by means of optical mark 8, and in so doing the control system thereupon displays by means of cursor 8' the precise control zone which is controlling the printing of the identified image point. Thus, the operator can obtain at a glance whatever information the display 7 is displaying with respect to that image point, such as ink control settings, actual optical densities, target optical densities, optical tolerances and the like. In addition, after viewing that correlated information, the pressman may also, by means of correlating the ink control zone on the display 7 to a particular pair of ink control keys 5, 6, manually adjust the printed density in the control zone which is printing the identified image point.

The ink adjustment control is by way of electrical connection 24 which operate through transfer switch 23 (when in its dotted line position) to produce electrical signals on a line 22 which operate an electrical actuator 21 to control the position of an ink adjustor 20 which in turn controls the thickness of ink film on an ink fountain or ductor roller 19. (While the ink fountain is shown only in end view, it will be appreciated that the length of the fountain has a plurality of ink adjusters 21 operating on individual ink keys 20 (or an elongated but flexible unitary blade) to control the ink film thickness along the roller 19 in increments of about 2" or less to provide zone-by-zone control of ink feed and thus printed optical density to the press which is printing the form 2. The transfer switch 23 and its further associated control line 25 also provides for automatic control of ink adjustment by way of electronic display 9. For example, circuitry can be provided in the display 9 which matches actual printed values to target values and, on a zone-by-zone basis, when there is a differential between those values, produces control signals on a line 25 which are coupled through transfer switch 23 to operate individual ones of the adjusters 21 to control on a zone-by-zone basis the ink feed in the zones which need adjustment.

As additional features of the invention which have not been emphasized thus far, the following are noted and will be further described in connection with operation of the invention in particular modes. First of all, a control line 16 couples signals produced by the electronic control 13 to the position control portion (the joystick portion 14) of the control panel 1. Such electrical signals allow the electronic control circuitry 13 to produce coordinate information which in turn positions the optical mark 8 in accordance with image points demanded within the electronic control 13. This is, in effect, the reverse of the operation wherein the pressman operates the joystick 14 to position the mark 8 to a point he desires; in this mode, the electronic control 13 traverses the optical mark 8 to identify a selected image point to the pressman.

It was noted above that the electronic control 13 operates on the electronic display 9 for performing translation of hard copy image point coordinates to zone-by-zone display coordinates. It was also noted but not emphasized that the electronic control 9 has the capability of making ink form adjustments directly (in dependence upon the standard capabilities built into such electronic display), and the double-headed arrow 26 is intended to indicate that control signals flow in both directions on that bus. In some applications, for example, the optical display 7 is in the form of a commercially available "touch screen" having touch sensitive areas positioned across the screen on a zone-by-zone basis. Using a touch sensitive screen, the operator simply depresses an increase or decrease portion of the touch screen in the desired zone to increase or decrease the amount of ink supplied to the press, and signals generated by the operator in touching the sensitive portions of the screen are transmitted both on line 26 for informing the control circuitry 17 of the change to be made, as well as on line 25, to the adjuster 21 for making the change.

The electronic control 13 has a portion of its memory dedicated to zone-by-zone control information which can be used for a variety of purposes, both to control the ink fountain directly or to display control information on the display 7 on a zone-by-zone basis. To that end, a memory section 27 is segregated in electronic control 13 and, as illustrated by vertical division lines 32, such memory 27 is divided into individual areas related to the respective control zones. The vertical lines 32 are simply intended to indicate that the memory 27 stores information for the control zones on a zone-by-zone basis. That limitation is not intended to infer a particular memory organization (with particular addresses dedicated to individual zones), but can also refer to a zone-by-zone organization where information in the memory has control zone identifiers or flags associated therewith such that it can be segregated (and displayed if necessary) on a control-zone-by-control-zone basis.

As will be described in greater detail below, in certain embodiments it is desirable to forego the visual display 7 while retaining the functionality of the invention in relating particular image points on the hard copy 2 to control zones in the electronic controller 13. In such embodiments, the memory configuration 27 which stores control zone information as it relates to particular control zones is important, and performs the correlation of image point to electronic control zone in accordance with the present invention.

The optical light source 10 is illustrated as being positioned external to the control panel 1 for purposes of traversing the optical mark 8 across the surface of the printed form 2. In some cases, the printed form 2, which can often be a composition pattern used to make the printing plate, is transparent; in those situations a light source 17 can be provided for backlighting the hard copy display 2 and is located within the control console 1 for projecting the optical mark 8 through the transparent hard copy 2. In either case, however, the light source is preferably coherent, is fixed with respect to the same reference which fixes the control console 1, and serves to identify a particular coordinate set (typically X and Y coordinates) of the optical mark 8 on the registered image on the control panel. In some circumstances, it may be adequate to identify only horizontal positions on the hard copy image 2, and in those cases the optical source 10 or 17 need identify only a horizontal coordinate for its traverse, and that horizontal coordinate of the optical mark 8 is translated into control zone information in the electronic controller 13.

The electronic control has been described functionally in terms of the operations it performs or controls within the system and structurally in terms of the zonal memory 27 which forms a part of it. Typically, the electronic control 13 is configured as a microprocessor based control with associated program memory and working memory for performing the functions attributed to it herein. The nature of the program memory for achieving such control can take many forms based on the various system configurations and modes of operation described in the present specification. The important point, however, is the production of coordinate information relating to the position of the optical mark on the registered image, the positioning of the optical source to illuminate the point identified by the coordinates, and a correlation of both coordinates with the electronic zone-by-zone stored information (as stored in memory 27 or displayed on electronic display 7). Those aspects of the invention, having been described in detail herein, can be implemented by one skilled in this art by conventional programming techniques, and the program steps are not described in further detail herein. Suffice it to say that the program steps will be most affected by the nature of the commercially available positioner for the light source 10 as well as the nature of the drive for the commercially available electronic display 7, and thus describing further details herein is believed to be unnecessary for a complete understanding of the substance of the invention as opposed to its application to commercially available hardware.

An understanding of the invention will be further enhanced with reference to description of exemplary modes in which the system is utilized for adjusting press parameters on a zone-by-zone basis.

In a preferred mode, the system of the invention is utilized in conjunction with a zone-by-zone display 9. At the start, the operator will have positioned a hard copy 2 of the image 3 on the control panel, located with respect to the register marks 31. In conventional fashion, the display 7 will display control zone information on a zone-by-zone basis, and such information can relate to ink settings, target densities or actual printed densities for each of the zones which are producing the image. If the pressman desires to examine a particular control zone to determine whether an adjustment should be made, or to determine whether a particular portion of the image is being printed within tolerances, the pressman operates the joystick 14 to produce signals which cause the electronic control circuit 13 to traverse the optical source 10. The pressman monitors the position of the optical mark 8 with respect to the image while operating the joystick 14 until the optical mark 8 is over and thereby identifies a particular image point on the hard copy 2. It will now be appreciated that the control system 13 contains information regarding the coordinates of the position of the mark 8 with respect to the image 2, and the control system performs a translation of that coordinate information into zone-by-zone information normally understood by the control system. Such translation is used in certain embodiments to store information in the zone-by-zone memory 27. Also in practicing the invention according to the currently described aspect, the translation causes signals to be coupled on line 26 to the electronic display 7 and to illuminate the cursor 8′ on the electronic display screen 7 at a position corresponding to that of the optical mark 8 on the hard copy 2. Thus, the operator knows at a glance the control zone or zones which are effective to control the image point identified by optical mark 8, and can determine ink settings for that control zone, can determine whether the control zone is printing within limits, and the like. In addition, the operator has the opportunity to adjust the control zone either by using the touch screen, by automatic operation of the electronic display 9, or through manual adjustment of the keys 5, 6 which correspond to the zone identified by cursor 8′ or optical mark 8.

By continued manipulation of the joystick 14, the operator has the ability to traverse the optical mark 8 across the image 3 of the hard copy 2 and to determine whether the control zones which are producing those portions of the image are within tolerances, whether the ink settings are at acceptable levels, and in addition to make adjustments to the particular control zones while determining the effect of those adjustments by means of the electronic display 9. There is thus provided a definite example of how a pressman would utilize the system of FIG. 1 in controlling ink feed for a particular form. However, the basis for such control should also be broadly noted, and that basis is the opportunity to transfer positional information to or from related devices. One of such related devices includes a hard copy controllably illuminated by a controllably positioned optical mark having coordinate information associated therewith, the other being an electronic representation needed to produce reproductions of the hard copy, but in a form where the electronic representation does not actually include the pattern of the image. Thus, the system allows the operator viewing the pattern of the image adequate capability to easily and simply at a glance make the necessary correlation in an accurate and efficient manner.

As noted above, in certain applications it is possible to derive certain advantages of the invention without the preferred electronic display. Thus, it was noted that the zone-by-zone memory 27 provides certain of the correlation aspects of the present invention, but without necessity for actually displaying the control zones to the operator by means of an electronic display 7.

In one such implementation of the invention, adjustment or set-up instruction are performed using a control console 1 and associated light source 10 to produce image point information which is stored in the zone-by-zone memory 27. Such implementation takes advantage of the fact that the operator has complete freedom using the joystick 14 to traverse the optical mark 8 to any point on the image and using an auxiliary key (not shown) can produce a "transfer coordinate" signal which will cause the coordinates related to the identified image point to be stored in a particular location in the zone-by-zone memory 27. That operation can be bidirectional. More particularly, in some instances, it is useful for the operator to manually traverse the optical mark 8, then transfer coordinates of the manually positioned mark to the control system 13. In other applications, it is desirable for the control system 13 to operate by means of electronic connection 16 to traverse the optical mark 8 automatically to predetermined positions whose coordinates are stored in the zone memory 27, then to allow the operator to perform such functions in the control zone associated with the image point identified by the automatically positioned optical mark 8.

Referring to the second form of operation first, the zone-by-zone memory 27 stores coordinate information for a plurality of image points on the form for which the system desires information, such as optical density information. Such optical density information is to be derived under the control of the pressman, but when derived is to be input into the electronic control system 13 for storage in the zone-by-zone memory 27. In order to initiate a sequence of such information acquisition, the electronic control system 13 outputs on the line 16 the coordinate information for a first image point for which zone information is to be acquired. The electronic control system 13 thereupon produces signals on the line 12 which drive the optical source 10 to the coordinates related to the stored coordinate information, to position the optical mark 8 on the hard copy 2 at the position determined by the coordinates stored in memory 27. After such automatic positioning, the operator is appraised that control information is desired for the image point in question and, in the example being considered, causes an optical density reading to be taken at the point indicated by the optical mark. That information is conveyed to the control system 13, either directly from the densitometer or by keying in such information, and is stored in the zone-by-zone memory 27. Having received the information, the system thereupon extracts the next set of coordinate information for the next image point to be determined, repositions the optical mark 8 and accepts the next item of zone control data which is input by the operator.

The system also provides for a further method of operation which takes advantage of operator positioning of the optical mark 8 by means of the joystick 14 followed by inputting of coordinate information so that the electronic control system 13 can relate image points so-indicated with controlled information stored in the zone-by-zone memory. Thus, the operator positions the light source 10 by manipulation of the joystick 14, acting through the signals accepted by and produced by the electronic control system 13, to traverse the optical mark 8 to a desired image point. Having thus positioned the optical mark 8, the operator signals the electronic control system 13 that the coordinate information is to be stored, for example, by depression of an enter key (not shown). As a result, the X and Y coordinates of the position of the light source 8 are detected and stored in the zone control memory 27 in locations relating to the zone which controls the image point. This operation allows the operator to input key points which are required by the control system for achieving its zonal control. Such key points include the coordinates of measuring points at which optical density measurements are to be taken, the coordinates of measuring marks or register marks which are to be sensed for ink control, water control or register control, the location of ink-free zones which may be scanned by a densitometer, the X and Y coordinates of a shifted subject (position of the useful zone on the printing plate), the identification of coordinates of zones which are important for proper reproduction of the image, of zones to be adjusted (automatically or manually) and of a measuring strip positioned along the foot or head of a sheet or form, as well as inputting coordinates to serve as an electronic foot rule. The operator can input all of this information (or any parts of such information) simply by manipulating the joystick to position the cursor 8, then by signalling a simple entry of the data or a data entry with an indicator of the nature of the data by using a key pad (not shown). By virtue of the correspondence between the coordinate information stored in the electronic control system which has positioned the cursor, the electronic control system 13 then makes the necessary correlation between the data which has been input and the zone related to the image point and stores such information in appropriate locations in the zone-by-zone memory 27.

It will now be appreciated that what has been provided is an improved electronic control system for a printing press which is comparatively inexpensive (as compared with systems using video cameras) but which provides a high degree of automatic correlation between a hard copy image of the form being printed and the electronic control zones which control the quality of the form being printed.

What is claimed is:

1. A system for coordinating a zonal control in a printing press to a hard copy image of a printed form, the system comprising, in combination:

a support having register means for positioning and supporting the hard copy image;

electronic memory means having control zones for controlling the respective zones of the printing press to produce reproductions of the image, the electronic memory means storing control information for the respective zones but not storing the actual image pattern;

optical means for projecting a mark onto the hard copy image registered on the support to identify a selected image point, optical control means for traversing the mark across the registered image and for producing coordinate information relating to the image point identified by the projected mark; and translating means for translating the coordinate information into control information for the control zones and storing the control information in the electronic memory means thereby to coordinate hard copy image points with the control zones which control the reproduction of the image.

2. The system of claim 1 further including an electronic display for displaying information stored in the electronic memory means related to the printed form on a control zone by control zone basis, a cursor on the electronic display, and means for coordinating the cursor position on the electronic display with the projected mark position on the hard copy image thereby to aid in coordinating hard copy image information with control zone information.

3. The system as set forth in claim 2 further including a plurality of ink control keys located in a control panel associated with said support, individual keys being displaced from each other on a zone-by-zone basis relating to the control zones of the electronic memory means, and means responsive to actuation of individual ones of the keys for increasing or decreasing the amount of ink supplied in the zone associated with said key.

4. The system as set forth in claim 2 wherein the display screen includes a zone of contact sensitive areas positioned in areas of the display screen relating to the different control zones, and the electronic means includes means for responding to contact with individual ones of the contact sensitive areas for adjusting the ink supply in the control zone associated with the contacted area.

5. The system as set forth in claim 1 in which the electronic memory means has a plurality of storage locations for the respective control zones, and means for storing coordinate information in the respective locations;

the optical control means including means for generating a control point storage signal for transferring the coordinate information relating to a selected image point to one of said locations in the memory means;

the translating means including means for storing the coordinate information in the location of the memory means related to the control zone which controls the selected image point, thereby to relate particular image points to control zones in the memory means.

6. The system as set forth in claim 1 wherein the electronic memory means includes a plurality of locations for storing image point data, the image point data comprising information derived at particular image points of the hard copy image;

the translation means including means for producing coordinate information for the respective image points;

the optical control means including means for responding to the translated coordinate information to translate said optical means to position the projected mark at the image point specified by said translated coordinate information, thereby to display to the operator on the hard copy image the actual image point for which the system requires information.

7. The system as set forth in claim 1 wherein the optical control means further includes a manually operable omni-position control coupled to the optical control means for traversing the projected mark across the registered image.

8. A system for coordinating an electronic ink feed zonal control in a printing press to a hard copy image of the printed form, the system comprising the combination of:

a support having register means for registering the hard copy on the support;

an electronic display having control zone locations for displaying ink control information for the printed form on a zone-by-zone basis, the electronic display having no image of the printed form displayed thereon;

optical means for projecting a mark onto the image registered on the support, optical control means for traversing the projected mark across the registered image and identifying a unique coordinate set defining the position on the image identified by the projected mark;

electronic coordination means for responding to the coordinate set received from the optical control means and in response thereto for producing an image of a cursor on the electronic display correlated to the position of the projected mark on the hard copy image, thereby to allow an operator the opportunity to correlate image information from the hard copy to control information on the electronic display.

9. A method of coordinating electronic control in a printing press on a zone-by-zone basis to a hard copy image of the printed form, the method comprising the steps of:

supporting a hard copy image of the printed form in a registered position with respect to a reference;

electronically storing, in a zone-by-zone memory having locations for storing control information but no locations for storing image pattern information, control information related to each of the zones for producing reproduction of the image;

traversing an optical mark across the registered image and defining coordinates of an image point selected during said traverse;

coordinating the position of the optical mark on the hard copy image with the associated zone locations in the electronic memory so as to coordinate the hard copy image areas identified by traverse of the optical mark with the control zone information in the electronic memory which control reproduction of the image.

10. The method as set forth in claim 9 further including the steps of:

displaying on an electronic display the control information stored in the zone-by-zone memory, said information being displayed on the electronic display on a zone-by-zone basis;

displaying a cursor on the electronic display, and coordinating the position of the cursor on the electronic display with the coordinates of the optical mark on the hard copy image, thereby to aid in coordinating hard copy image information with control zone information.

11. The method as set forth in claim 9 in which the step of electronically storing includes storing coordinate information relating to selected image points of the hard copy; and the step of coordinating includes producing coordinate transfer information defining a particular image point on the hard copy image and transferring the coordinates of the defined image point to the zone-by-zone memory for the zone related to the selected image point.

12. The method as set forth in claim 9 further including the steps of:

storing coordinate information defining particular image points for which image point data is to be electronically stored in the electronically storing step;

the step of electronically storing including storing control information derived from the printed image in locations corresponding to the particular image points;

the traversing step including responding to the coordinate data for the particular image point and traversing the optical mark to the selected image point for displaying to the operator the image point for which data is to be derived; and deriving and storing data at the image point indicated by the optical mark.

13. A method for coordinating ink feed control in a printing press to a hard copy image of a printed form, the method comprising the steps of:

supporting a hard copy image of the printed form in a registered position with respect to a reference;

electronically storing in a zone-by-zone memory ink control information related to each of the zones for producing the hard copy image;

storing in said memory at least information identifying coordinates in the printed image for which the memory requires data input;

projecting onto the hard copy image an optical mark for traverse across the hard copy image and defining coordinates of the image point identified by the position of the optical mark;

automatically positioning the optical mark in dependence upon the coordinate information stored in the memory; and entering information into the memory from the image corresponding to the image point identified by the optical mark.

* * * * *